US009340007B2

(12) United States Patent
D'Annunzio et al.

(10) Patent No.: US 9,340,007 B2
(45) Date of Patent: May 17, 2016

(54) DEVICE AND METHOD FOR REPLACING THE PRINTING ROLLERS OF A PRINTING UNIT, PARTICULARY FOR IN-LINE FLEXOGRAPHIC ROTARY MACHINES

(71) Applicant: Bobst Firenze S.r.l., Campi Bisenzio (Florence) (IT)

(72) Inventors: Federico D'Annunzio, Florence (IT); Giacomo Maccalli, Lodi (IT); Mauro Maccalli, Lodi (IT)

(73) Assignee: BOBST FIRENZE S.R.L., Campi Bisenzio (IT)

( * ) Notice: Subject to any disclaimer, the term of this patent is extended or adjusted under 35 U.S.C. 154(b) by 0 days.

(21) Appl. No.: 14/894,160

(22) PCT Filed: Apr. 11, 2014

(86) PCT No.: PCT/EP2014/057431
§ 371 (c)(1),
(2) Date: Nov. 25, 2015

(87) PCT Pub. No.: WO2014/202255
PCT Pub. Date: Dec. 24, 2014

(65) Prior Publication Data

US 2016/0101616 A1 Apr. 14, 2016

(30) Foreign Application Priority Data

Jun. 18, 2013 (IT) ..... MI2013A1003

(51) Int. Cl.
*B41F 13/34* (2006.01)
*B41F 27/00* (2006.01)
(Continued)

(52) U.S. Cl.
CPC . *B41F 27/00* (2013.01); *B41F 9/18* (2013.01); *B41F 13/16* (2013.01); *B41F 13/24* (2013.01); *B41F 13/30* (2013.01); *B41F 13/34* (2013.01)

(58) Field of Classification Search
CPC ..... B41F 5/00; B41F 7/00; B41F 9/00; B41F 9/18; B41F 13/0024; B41F 13/16; B41F 13/24; B41F 13/34
USPC ..... 101/153, 216, 249, 479, 480, 486
See application file for complete search history.

(56) References Cited

U.S. PATENT DOCUMENTS 5,692,442 A * 12/1997 Leanna ..... B41F 5/24 101/247
5,906,162 A * 5/1999 Kolbe ..... B41F 5/24 101/216

(Continued)

FOREIGN PATENT DOCUMENTS

DE 4413807 C1 9/1995
EP 0611240 A1 8/1994

(Continued)

OTHER PUBLICATIONS

International Search Report based on International Application No. PCT/EP2014/057431, Mailed May 27, 2014.

*Primary Examiner* — Jill Culler
*Assistant Examiner* — Marissa Ferguson Samreth
(74) *Attorney, Agent, or Firm* — Lucas & Mercanti, LLP

(57) ABSTRACT

A device for replacing the printing rollers of a printing unit, particularly for in-line flexographic rotary machines is disclosed and includes a work station for a first, working printing roller, a holding station for a second printing roller, a removal station for a printing roller to be removed, movement means, for the movement of the first printing roller from the work station to the removal station and for the movement of the second printing roller from the holding station to the work station.

9 Claims, 5 Drawing Sheets

(51) Int. Cl.

| | |
|---|---|
| ***B41F 9/18*** | (2006.01) |
| ***B41F 13/16*** | (2006.01) |
| ***B41F 13/24*** | (2006.01) |
| ***B41F 13/30*** | (2006.01) |

(56) References Cited

U.S. PATENT DOCUMENTS

| | | | | | |
|---|---|---|---|---|---|
| 6,247,406 | B1 * | 6/2001 | D'Annunzio | B41F 13/24 | 101/153 |
| 6,318,257 | B1 * | 11/2001 | Niemiro | B41F 13/14 | 101/212 |
| 6,408,756 | B1 * | 6/2002 | D'Annunzio | B41F 13/24 | 101/216 |
| 2002/0108520 | A1 * | 8/2002 | Kolbe | B41F 5/24 | 101/479 |

FOREIGN PATENT DOCUMENTS

| | | | | | |
|---|---|---|---|---|---|
| EP | 1462254 | * | 9/2004 | B41F 13/24 | |
| FR | 2485990 | A1 | 1/1982 | | |
| WO | 2009144016 | A1 | 12/2009 | | |
| WO | 2015166409 | * | 5/2015 | B41F 5/24 | |

* cited by examiner

DEVICE AND METHOD FOR REPLACING THE PRINTING ROLLERS OF A PRINTING UNIT, PARTICULARY FOR IN-LINE FLEXOGRAPHIC ROTARY MACHINES

CROSS-REFERENCE TO RELATED APPLICATIONS

This application is a 371 of PCT/EP2014/057431, filed Apr. 11, 2014, which claims the benefit of Italian Patent Application No. MI2013A001003, filed Jun. 18, 2013.

FIELD OF THE INVENTION

The present invention relates to a device for replacing the printing rollers of a printing unit, particularly for in-line flexographic rotary machines.

BACKGROUND OF THE INVENTION

Nowadays, in the field of printing, and in particular in the field of printing labels and flexible packaging, the need is widely felt to increase the general efficiency of printing processes, on the one hand by reducing printing times and on the other hand by limiting the waste of material, such as the print medium.

In particular, the step of changing the printing rollers is one of the most critical steps of the entire printing process, in that the "job-change" times are dead times, in which the printing process is substantially interrupted. Furthermore, changing between two different print jobs generally involves great waste of material.

SUMMARY OF THE INVENTION

The aim of the present invention consists in providing a device for replacing the printing rollers of a printing unit, particularly for in-line flexographic rotary machines, which solves the above mentioned technical problems, eliminates the drawbacks and overcomes the limitations of the known art, by making it possible to increase the efficiency of printing processes.

Within this aim, an object of the present invention is to provide a device for replacing the printing rollers of a printing unit which makes it possible to reduce the "job-change" times and the wastes of material that are associated with such a "job-change".

Another object of the invention consists in providing a device for replacing the printing rollers of a printing unit which enables its application, in a flexible manner, on printing units that use different printing methods.

Another object of the invention consists in providing a device for replacing the printing rollers of a printing unit which is capable of offering the widest guarantees of reliability and safety in use.

Another object of the invention consists in providing a device for replacing the printing rollers of a printing unit which is easy to implement and economically competitive when compared to the known art.

This aim and these and other objects which will become better apparent hereinafter, are achieved by a device for replacing the printing rollers of a printing unit, particularly for in-line flexographic rotary machines, characterized in that it comprises:

- a work station or work position for a first, working printing roller
- a holding station or holding position for a second, held printing roller
- a removal station or removal position for a printing roller to be removed,
- movement means for the movement of said first printing roller from said work station or work position to said removal station or removal position and for the movement of said second printing roller from said holding station or holding position to said work station or work position.

This aim and these and other objects are also achieved by a method for replacing printing rollers of a printing unit, particularly for in-line flexographic rotary machines, which is characterized in that it comprises the steps of:

- having a first printing roller working in a work station or work position
- having a second printing roller held in a holding station or holding position;
- moving, by way of movement means, said first printing roller from said work station or work position to a removal station or removal position, and following, by way of said movement means, said second printing roller from said holding station or holding position to said work station or work position;
- removing said first printing roller from said removal station or removal position.

BRIEF DESCRIPTION OF THE DRAWINGS

Further characteristics and advantages of the invention will become better apparent from the detailed description of a preferred, but not exclusive, embodiment of a device for replacing the printing rollers of a printing unit, particularly for in-line flexographic rotary machines, which is illustrated by way of non-limiting example with the aid of the accompanying drawings wherein.

DETAILED DESCRIPTION OF THE INVENTION

Figure 1:
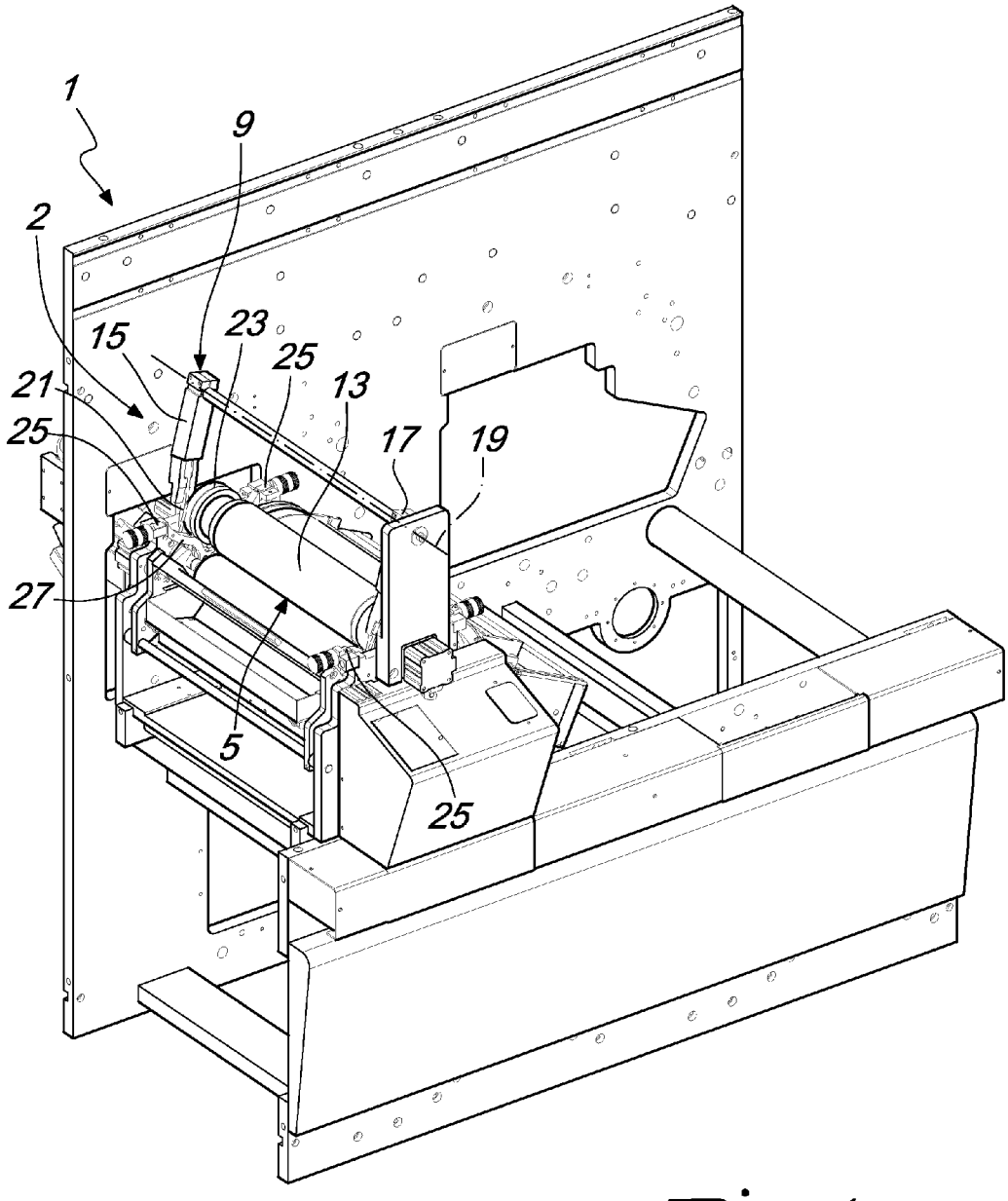
FIG. 1 is a perspective view of a printing unit of a flexographic machine in which there is an embodiment of the device for replacing the printing rollers, according to the invention.
Figure 2:
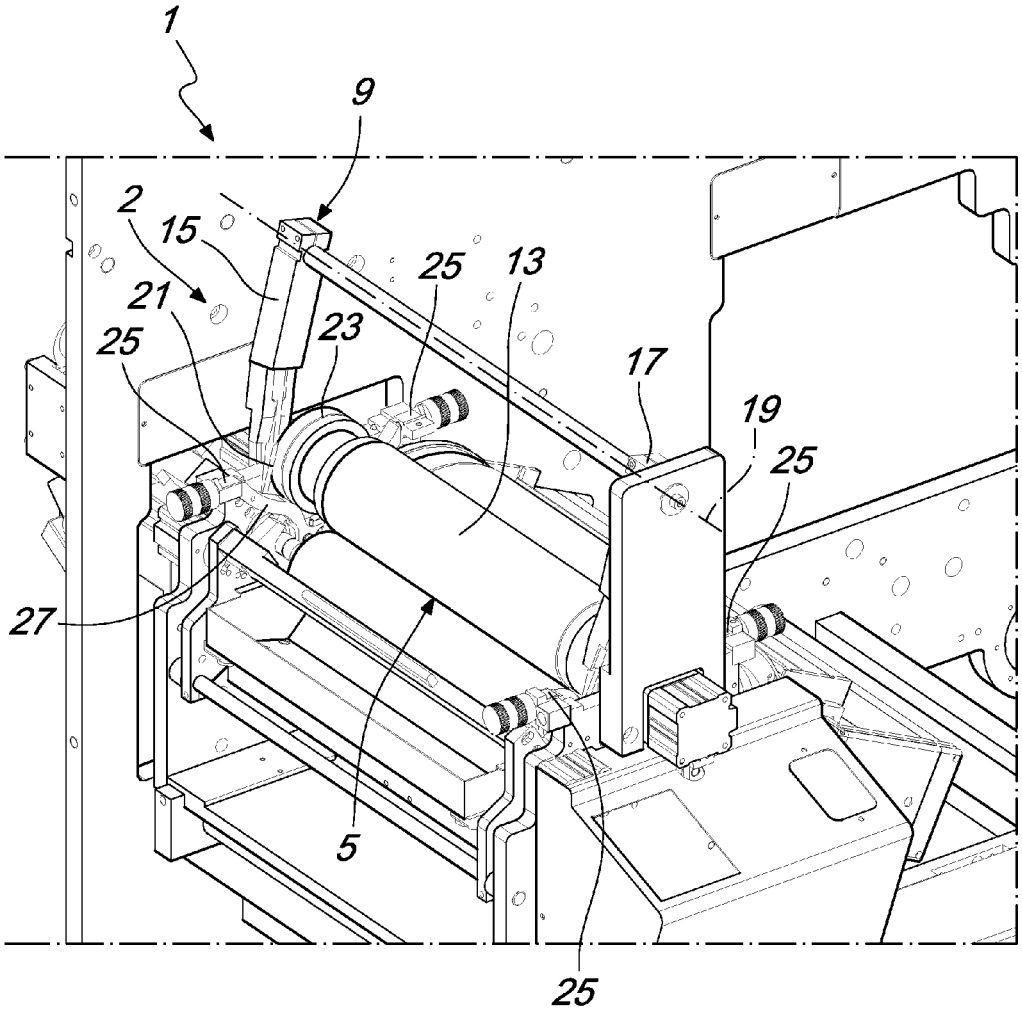
FIG. 2 is an enlargement of a portion of FIG. 1, showing in particular the printing unit, with the device for replacing the printing rollers, according to the invention.
Figure 3:
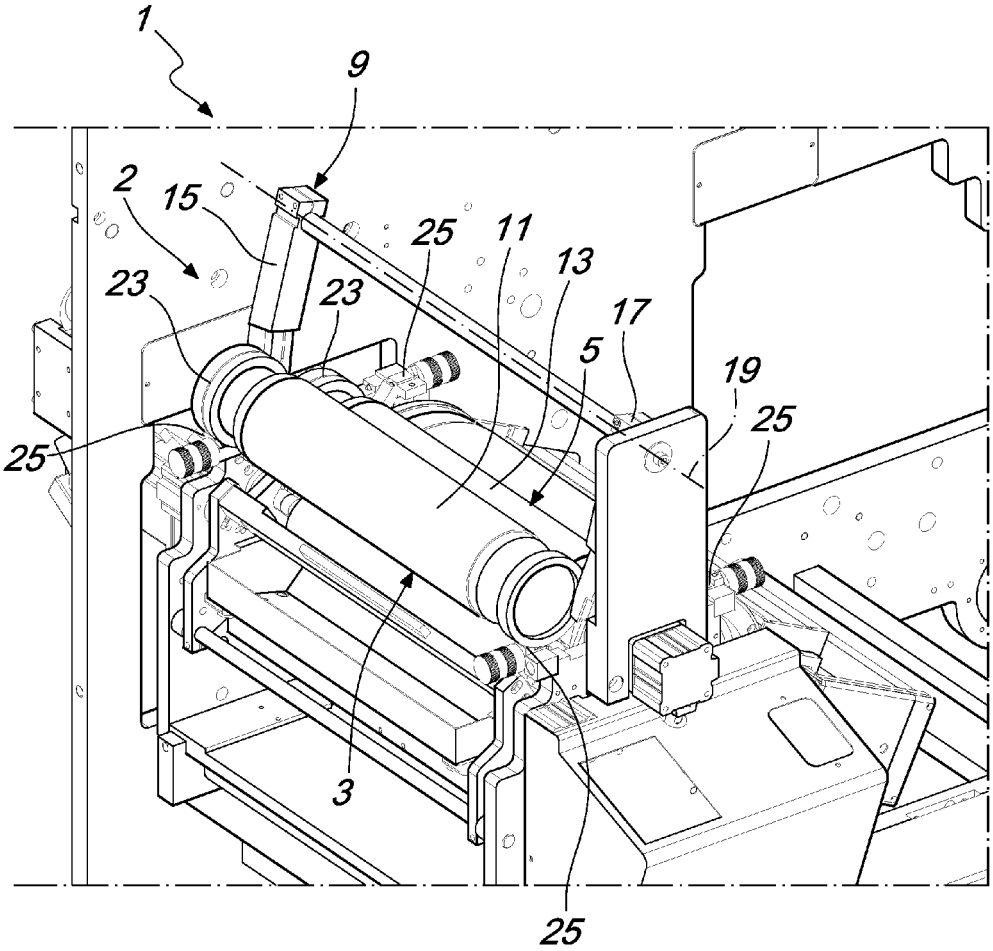
FIG. 3 shows the same enlargement as FIG. 2, in a situation in which a printing roller is shown held in a holding station or holding position, as well as a printing roller working in a work station or work position.
Figure 3A:
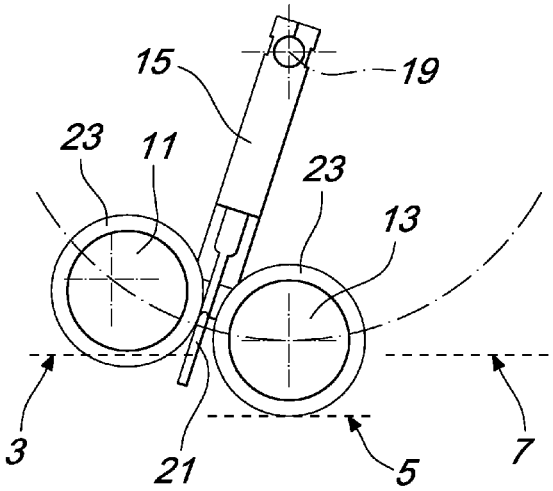
FIG. 3A is a schematic diagram of the situation in FIG. 3.
Figure 4:
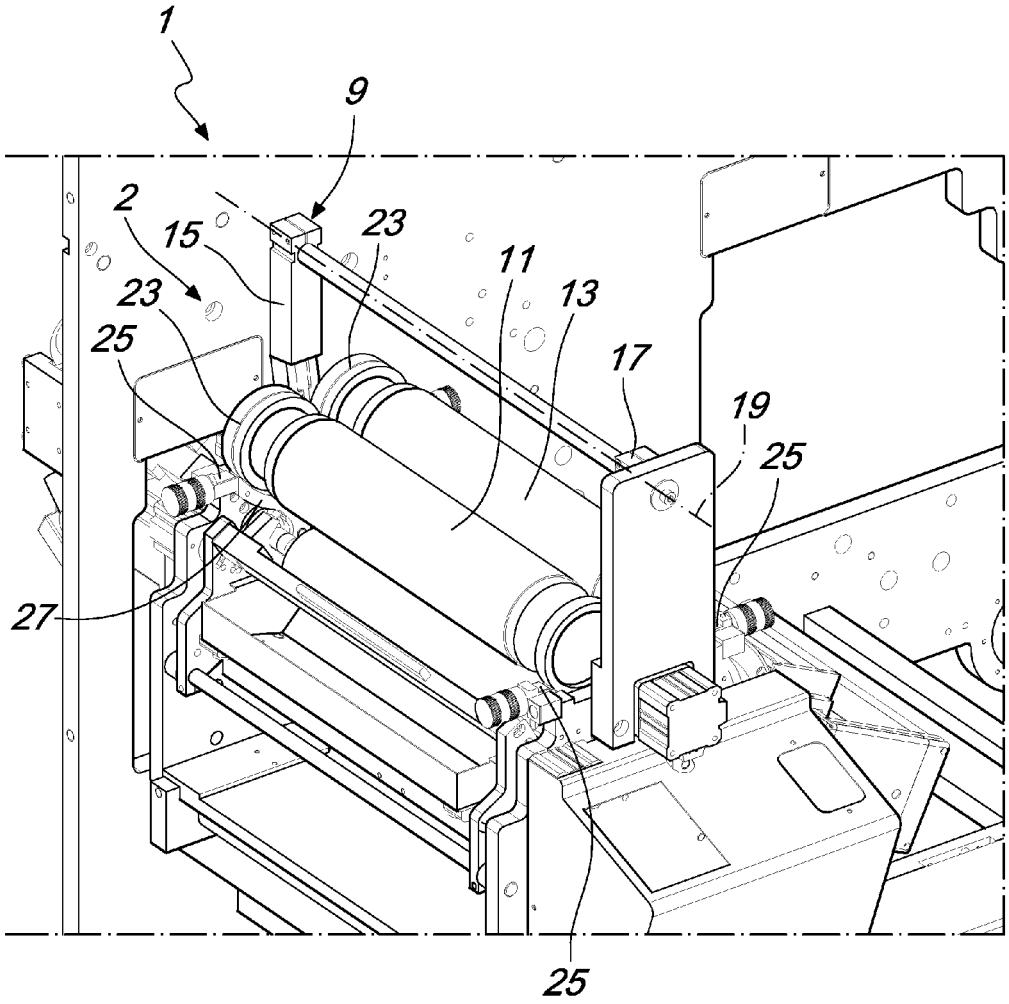
FIG. 4 shows the same enlargement as FIG. 2, in a situation in which a step is shown of moving the printing roller that was held in the holding station or holding position, and of moving the printing roller that was working in the work station or work position.
Figure 5:
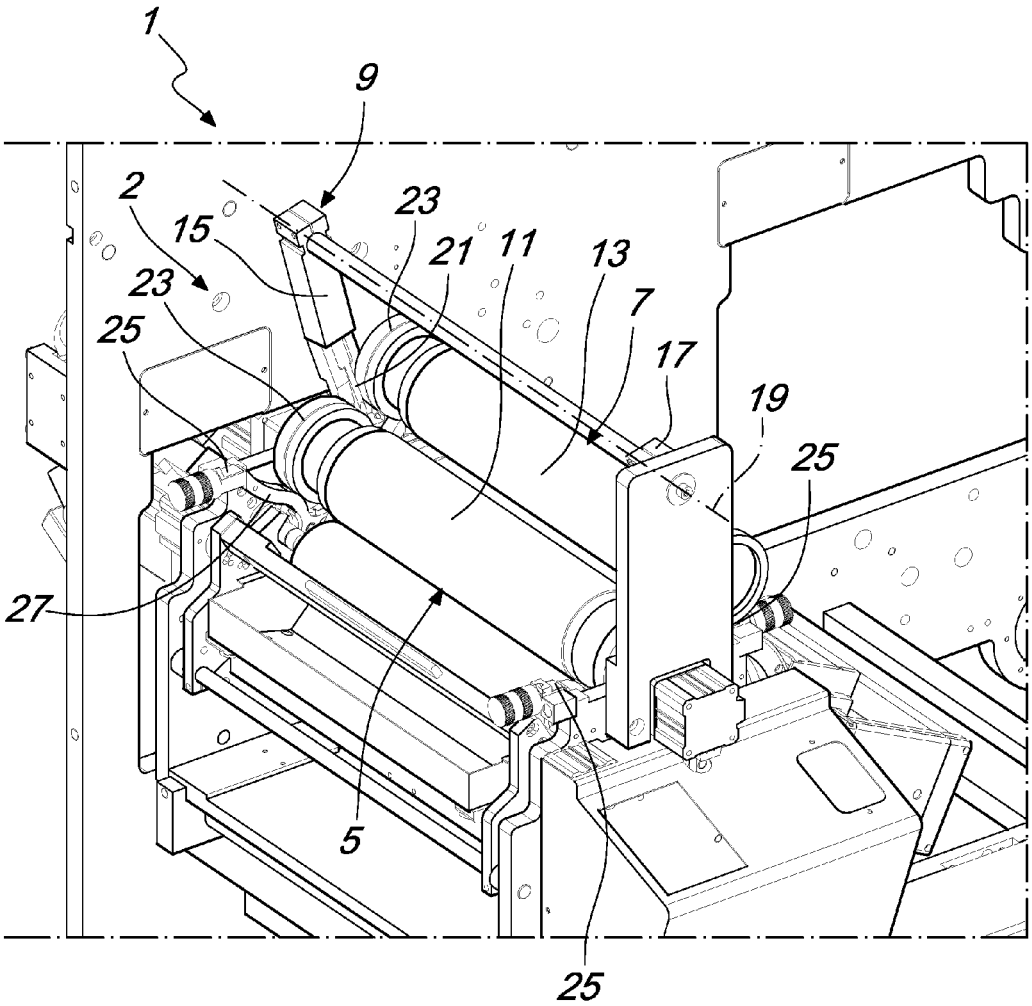
FIG. 5 shows the same enlargement as FIG. 2, in a situation in which a printing roller is shown working in a work station or work position, as well as a printing roller to be removed in a removal station or removal position.
Figure 5A:
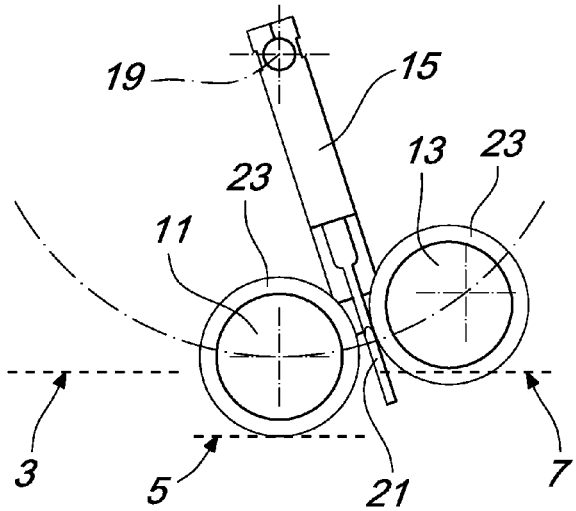
FIG. 5A is a schematic diagram of the situation in FIG. 5.

With reference to the figures, the device for replacing the printing rollers of a printing unit, particularly for in-line flexographic rotary machines, is generally designated by the reference numeral 1, while the printing unit is designated by the reference numeral 2.

According to the invention, the device 1 comprises:

a work station or work position 5 for a first, working printing roller 13, a holding station or holding position 3, 7 for a second, held printing roller 11, a removal station or removal position 7, 3 for a printing roller 11, 13 to be removed, movement means 9, for the movement of the first printing roller 13 from the work station or work position 5 to the removal station or removal position 7, 3 and for the movement of the second printing roller 11 from the holding station or holding position 3, 7 to the work station or work position 5.

In the accompanying figures, the holding station or holding position is designated with the reference numeral 3, while the removal station or removal position is designated with the reference numeral 7, because in the case shown, the movement of the rollers 11, 13 occurs from left to right. However, the station or position designated with the reference numeral 3 can be a removal station or removal position, and the station or position designated with the reference numeral 7 can be a holding station or holding position, i.e. the holding and removal stations or removal positions can switch their roles when the movement of the rollers 11, 13 occurs from right to left.

Advantageously, the movement means 9 comprise a pair of rods 15, 17 that are pivoted with respect to a pivoting axis 19, each one of the rods 15, 17 comprising an abutment protrusion 21 that is adapted to engage the lateral ends of the first printing roller 13 and of the second printing roller 11.

Furthermore, the lateral ends of the two printing rollers 11 and 13 advantageously comprise lateral discs 23, which are adapted to be engaged by the abutment protrusions 21 of the rods 15, 17.

Advantageously, the holding station or holding position 3 (and the removal station or removal position 7) are at a higher level than that at which the work station or work position 5 is arranged. The movement means 9, in fact, follow the sliding by gravity of the second printing roller 11 from the holding station or holding position 3 to the work station or work position 5. Obviously, when the station or position 7 plays the role of holding station or holding position, the movement means 9 follow the sliding by gravity of the printing roller 11, 13 from the station or position 7 to the work station or work position 5.

Furthermore, the holding and removal stations or positions 3, 7 advantageously comprise at least one stop element 25 in order to prevent the fall of the printing rollers 11, 13 laterally from the device 1, i.e. outside the printing unit 2.

The device 1 advantageously comprises sliding tracks 27 for the sliding of the printing rollers 11 and 13 from the holding station or holding position 3 to the work station or work position 5 and from the work station or work position 5 to the removal station or the removal position 7. Advantageously, furthermore, it is the lateral discs 23 of the printing rollers 11 and 13 that slide and/or rotate on the above mentioned sliding tracks 27.

The device 1 for replacing the printing rollers can be advantageously comprised in one or more, and preferably in all of the printing units 2 that are present in a flexographic machine, and in particular in an in-line flexographic rotary machine.

The invention also relates to a method for replacing printing rollers of a printing unit 2, particularly for in-line flexographic rotary machines, which comprises the steps of:

having a first printing roller 13 working in a work station or work position 5;

having a second printing roller 11 held in a holding station or holding position 3;

moving, by way of movement means 9, the first printing roller 13 from the work station or work position 5 to the removal station or removal position 7, and following, again by way of the same movement means 9, the second printing roller 11, from the holding station or holding position 3 to the work station or work position 5;

removing the first printing roller 13 from the removal station or removal position 7.

In this case also, the roles of the stations or positions 3 and 7 can be conveniently switched.

Furthermore, the step of moving the first printing roller 13 and following the second printing roller 11 is advantageously performed without stopping the printing process, and also advantageously it can be performed at any stage of the printing process.

Operation of the device is clear and evident from the foregoing description.

In particular, the device 1 makes it possible to position a new printing roller 11 on the printing unit 2 in a holding station or holding position 3, while the printing roller 13 that is working in the work station or work position 5 is completing the printing procedure. At the end of the printing step, the movement means 9 make the printing roller 13 that was working perform a translational motion laterally, along the sliding tracks 27, bringing it to the removal station or removal position 7, and at the same time allowing the sliding, by gravity along the sliding tracks 27, of the new printing roller 11, which was held in the holding station or holding position 3, into the work station or work position 5, in order to resume working. The printing roller 13, which has finished working, is now available for removal from the removal station or removal position 7. In short, the printing rollers 11 and 13 are moved from left to right, thanks to the movement means 9.

The substitution of the printing roller 11, which is now working, can be performed by positioning an additional new roller, not shown, in the station or position 7, and repeating the movement steps described in the other direction, i.e. sliding, by way of the movement means 9, the printing rollers from right to left.

Furthermore, if the device 1 is applied on all the printing units 2 of an in-line flexographic rotary machine, it is possible to change the printing rollers both selectively and sequentially.

With selective changing, in the event that only one roller needs to be changed, for example, in order to have a new text, a new language etc., the change can be done "on the fly" with no waste of material owing to machine shutdown, and to the consequent loss of the print register. The machine is not stopped, the device 1 performs the change on the selected printing station or position, with no loss or waste of any kind, immediately and perfectly in register.

With sequential changing, when the print job is to be changed, the changing of printing rollers occurs starting from a first printing unit, in which the "new" roller substitutes the "old" roller, as a result beginning to print the "new" job. The "old" job continues on its way to a second printing unit, and when the "new" job printed by the first printing unit arrives, the "new" printing roller of the second unit takes over from the old roller, printing the second color of the "new" job, perfectly in register with the first color of the new job, with no waste between the "old" and "new" jobs. The "old" job thus continues to a third printing unit, and when the "new" job printed by the first and by the second printing unit arrives, the "new" printing roller of the third group takes over from the old roller, printing the third color of the "new" job, perfectly in register with the first color and with the second color of the "new" job, with no waste between the "old" and "new" jobs. And so on for all the subsequent printing units, the procedure cascades with a sequential substitution of the "old" job with the "new" job without leaving any waste of material between the two jobs.

In practice it has been found that the device and the method for replacing the printing rollers of a printing unit, particularly for in-line flexographic rotary machines, according to the present invention, achieve the intended aim and objects in that they make it possible to increase the efficiency of the printing process, by reducing the job-change times and reducing the wastes of material. In fact, changing the rollers can be done at low speed without stopping the flexographic machine. This makes it possible to perform the job-change without disturbing the tension of the print medium, which continues to be entrained, and thus without loss of register, both in the "old" print job and in the "new" print job.

Another advantage of the device, according to the invention, consists in that it can be easily removed from the printing unit, with few operations, and thus it enables the rapid insertion into flexographic printing units of other printing processes.

The device and the method for replacing the printing rollers of a printing unit, particularly for in-line flexographic rotary machines, thus conceived, are susceptible of numerous modifications and variations, all of which are within the scope of the appended claims.

Moreover, all the details may be substituted by other, technically equivalent elements.

In practice the materials employed, provided they are compatible with the specific use, and the contingent dimensions and shapes, may be any according to requirements.

The disclosures in Italian Patent Application No. MI2013A001003 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A device for replacing the printing rollers of a printing unit for in-line flexographic rotary machines comprising:

a work position for a first printing roller, a holding position for a second, held printing roller, a removal position for said first printing roller to be removed, movement means for movement of said first printing roller from said work position to said removal position and for movement of said second printing roller from said holding position to said work position, wherein:

said movement means comprises a pair of rods that are pivoted with respect to a pivoting axis, each one of said pair of rods comprising an abutment protrusion that is adapted to engage lateral ends of said first printing roller and of said second printing roller, said holding position and said removal position are at a higher level than that of said work position, rotation of said pair of rods around said pivoting axis defining a region, said working position being arranged inside said region;

said removal position and said holding position being arranged outside said region on mutually opposed sides thereof, said holding position, said working position, and said removal position being affected by the rotation of said pair of rods within said region;

thereby said pair of rods are adapted to move said first roller toward the removal position rotating around said pivoting axis, as consequence the second roller moving by gravity from the holding position to the working position.

2. The device according to claim 1, wherein said lateral ends of said first printing roller and of said second printing roller comprise lateral discs that are adapted to be engaged by said abutment protrusions of said rods.

3. The device according to claim 2, wherein the device comprises sliding tracks for sliding of said first printing roller and of said second printing roller from said holding position to said work position and from said work position to said removal position.

4. The device according to claim 3, wherein said lateral discs of said first printing roller and said second printing roller slide and/or rotate on said sliding tracks during the movement of said first printing roller and second printing roller from said holding position to said work position and from said work position to said removal position.

5. The device according to claim 1, wherein said holding position and said removal position comprises at least one stop element in order to prevent fall of said first printing roller or of said second printing roller from said device.

6. A flexographic machine comprising a plurality of printing units, wherein each printing unit comprises a device for replacing the printing rollers according to claim 1.

7. A method for replacing printing rollers of a printing unit for in-line flexographic rotary machines comprising the steps of:

having a first printing roller working in a work position;

having a second printing roller held in a holding position;

moving, by way of movement means, said first printing roller from said work position to a removal position and following, by way of said movement means, said second printing roller from said holding position to said work position, removing said first printing roller from said removal position;

wherein said method comprising:

said movement means rotating around a pivoting axis effecting movement of said first printing roller toward the removal position and at the same time the second printing roller follows rotation of said movement means moving by gravity from the holding position to the working position.

8. The method according to claim 7, wherein said step of moving said first printing roller and of following said second printing roller is performed without stopping a printing process.

9. The method according to claim 7, wherein said step of moving said first printing roller and of following said second printing roller is performed at any stage of the printing process.

* * * * *